US006971189B1

(12) United States Patent
Anibas

(10) Patent No.: US 6,971,189 B1
(45) Date of Patent: Dec. 6, 2005

(54) VARIABLE VOLUME CLOTHES DRYER

(76) Inventor: Kevin J. Anibas, 2136 4th St., Eau Claire, WI (US) 54703

( * ) Notice: Subject to any disclaimer, the term of this patent is extended or adjusted under 35 U.S.C. 154(b) by 0 days.

(21) Appl. No.: 11/015,811

(22) Filed: Dec. 20, 2004

(51) Int. Cl.[7] ..... F26B 5/08
(52) U.S. Cl. ..... 34/602; 34/603; 34/604
(58) Field of Search ..... 34/602, 603, 604

(56) References Cited

U.S. PATENT DOCUMENTS 857,161 A * 6/1907 Oumer ..... 432/109
2,150,620 A * 3/1939 Frost ..... 220/9.2
2,518,582 A * 8/1950 Vincent ..... 34/548
2,637,189 A * 5/1953 Douglas ..... 68/23.4
3,427,960 A * 2/1969 Napolitano ..... 100/218
3,815,258 A 6/1974 Beard, Jr.
3,922,798 A * 12/1975 McMillan ..... 34/73
3,946,500 A 3/1976 Barrett et al.
5,495,681 A 3/1996 Paradis
5,555,639 A * 9/1996 Livingston et al. ..... 34/135
5,555,645 A 9/1996 Joslin
5,572,803 A 11/1996 Moriya
5,573,186 A 11/1996 Loschelder
6,212,792 B1 * 4/2001 Bier ..... 34/315
6,223,452 B1 5/2001 Hamand
6,381,874 B1 5/2002 Floyd

* cited by examiner

*Primary Examiner*—Stephen Gravini
(74) *Attorney, Agent, or Firm*—Tipton L Randall

(57) ABSTRACT

The invention is a clothes dryer featuring an interior working volume that is adjustable to suit the size of the load and type of article(s) to be dried. Since the volume is adjusted to fit the load, only the necessary volume is heated. For large loads or bulky articles, the volume is set to full, while for small loads and small articles the volume may be decreased for faster drying and energy savings. The dryer working volume is adjusted by a simple manually operated linkage, or, in other embodiments, by motorized mechanisms.

21 Claims, 7 Drawing Sheets

VARIABLE VOLUME CLOTHES DRYER

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention is a clothes dryer with an internal working volume that is adjustable to suit the size of the load.

2. Background Information

The invention is a clothes dryer featuring an internal working volume that is variable to suit the size of the load and type of article(s) to be dried. The purpose of the invention is to reduce drying time and energy consumption.

Presently available clothes dryers feature controls and cycles to suit most fabrics and types of articles likely to be dried by them. While drying speed and energy efficiency has improved over earlier machines, one area that has not been addressed is that of the working volume of the dryer. With the currently available machines, the same internal volume must be heated, regardless of the size of the load and the type of articles being dried. Additionally, many users remove articles from a full load as some of the articles dry, leaving a smaller load in process. These smaller loads do not require the same volume as large loads, and this represents a waste of energy.

Some examples of inventions concerning dryers for which patents have been granted include the following: U.S. Pat. No. 3,815,258 by Beard, Jr.; U.S. Pat. No. 3,946,500 by Barrett, et al.; U.S. Pat. No. 5,495,681 by Paradise; U.S. Pat. No. 5,555,645 by Joshi; U.S. Pat. No. 5,572,803 by Moriya; U.S. Pat. No. 5,573,186 by Loschelder; U.S. Pat. No. 6,223,452 by Hamand, and U.S. Pat. No. 6,381,874 by Floyd.

Applicant has invented a clothes dryer which provides an adjustable working volume that decreases drying time, and conserves energy. The internal volume of the dryer drum is adjusted by a simple manually operated linkage or, in an alternative embodiment, by a more elaborate motorized mechanism.

SUMMARY OF THE INVENTION

The invention is a clothes dryer in which the internal working volume of the drying drum is adjustable to suit the size of the load and type of article(s) to be dried. The device works by translating a movable rear panel forward into the drying drum. As the rear panel moves forward, the open depth of the drying drum, and therefore its volume, decreases. A conventional heating unit and exhaust are connected to the movable rear panel by means of telescoping ducts or flexible ducts. It is contemplated that in some embodiments of the invention, a portion or all of the heating and exhaust apparatus is incorporated into the movable rear panel. A seal is attached to the periphery of the movable rear panel so that heat does not escape from the joint between the rotating drum and the rear panel. A telescoping baffle member is incorporated into the drum to tumble the article(s) being dried. The baffle member decreases or increases in length as required by the movement of the movable rear panel. The baffle member is spring-biased and contacts the surface of the movable rear panel with a follower wheel to maintain the baffle member's length, appropriate for the depth of the drying drum.

Generally, the working volume of the drying drum is set to maximum or full for large loads and set to a fraction of the full volume for smaller loads. The working volume of the drying drum may also be decreased as dry articles are removed from a load in process. The rear panel is positioned by a simple, manually operated linkage or by a more elaborate motorized mechanism.

One embodiment of the invention is a container for tumbling clothes in a clothes dryer appliance. The container comprises a drum member rotatable on a horizontal, cylindrical axis. The drum member includes a sidewall, a front panel with an access opening therein adapted for inserting and removing material to be tumbled, and a rear panel moveably joined to the drum member's sidewall by a peripheral seal to form a contained volume in the drum member. The rear panel includes an inlet and an outlet for circulating temperature conditioned air through the drum member's contained volume. A mounting and translational assembly is secured to the rear panel for axial movement of the rear panel within the drum member to adjustably vary the drum member's contained volume, with the rear panel held non-rotating during rotation of the drum member.

Another embodiment of the invention is a clothes dryer appliance comprising a dryer chassis with a drum member rotatably mounted within the dryer chassis on a horizontal, cylindrical axis. The drum member includes a sidewall, a front panel with an access opening therein adapted for inserting and removing material to be tumbled, and a rear panel moveably joined to the drum member's sidewall by a peripheral seal to form a contained volume in the drum member. The rear panel includes an inlet and an outlet for circulating temperature conditioned air through the drum member's contained volume. At least one baffle member is secured axially to an internal surface of the sidewall to promote tumbling of material within the drum member. A mounting and translational assembly is secured to the rear panel for axial movement of the rear panel within the drum member to adjustably vary the drum member's contained volume, with the rear panel held non-rotating during rotation of the drum member. A door in the dryer chassis provides access to the drum member's access opening. A drum rotating motor and drive belt assembly is positioned within the dryer chassis and drivably coupled to the drum member for rotation thereof. A heating unit is present for providing temperature conditioned air to the drum member's rear panel inlet.

DESCRIPTION OF THE EMBODIMENTS

NOMENCLATURE

Figure 1:
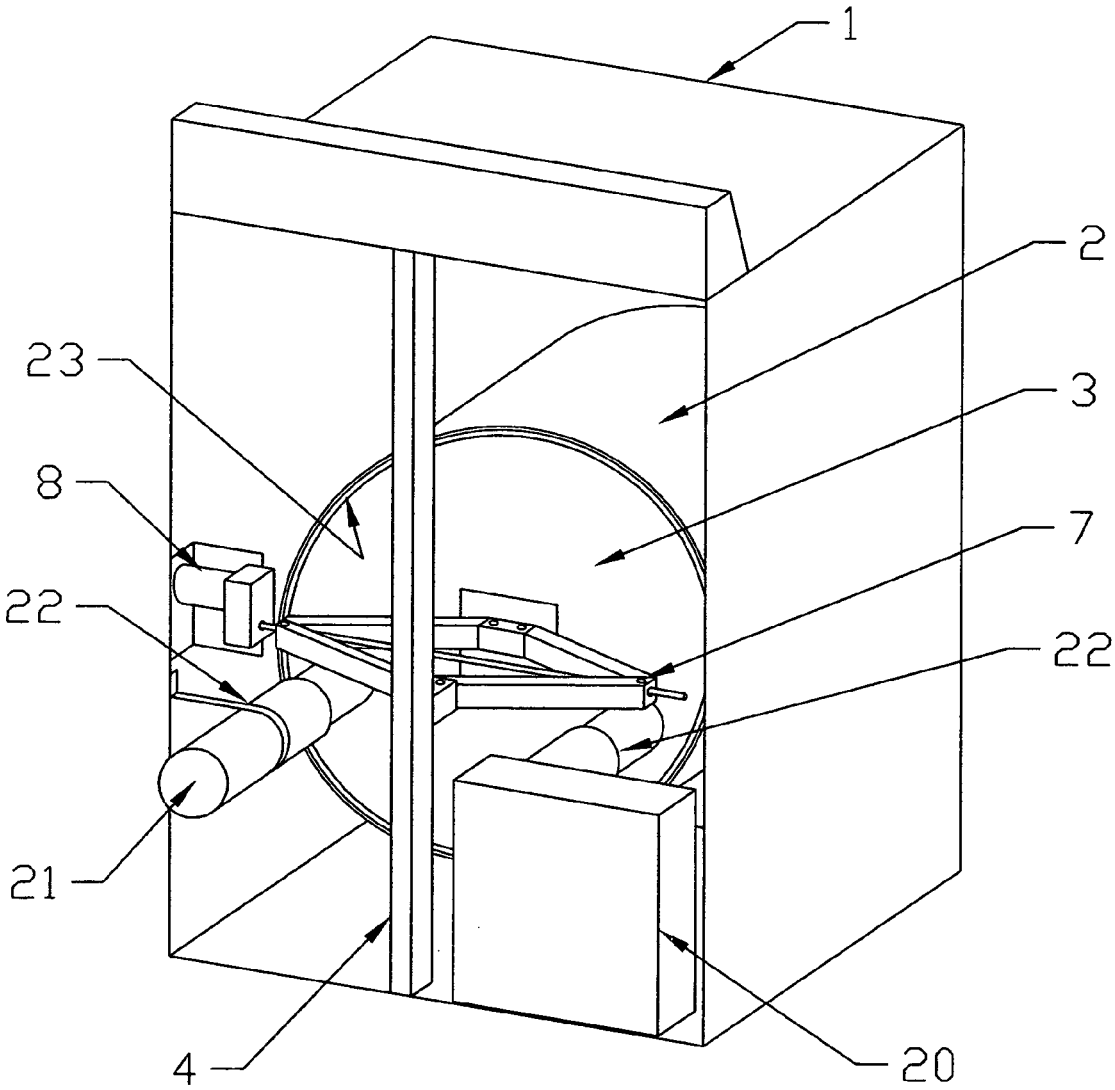
FIG. 1 is a rear perspective view of a clothes dryer with the invention incorporated. This figure shows an embodiment with a motorized scissor actuator.

1 Dryer Chassis
2 Rotating Drum Member
3 Movable Rear Panel of Drum Member
3*a* Exterior Surface of Rear Panel
4 Rear Panel Mounting Structure
5 Telescoping Translational Mechanism
6 Protrusion for Additional Engagement
7 Scissor Mechanism
8 Scissor Mechanism Drive Motor
9 Actuation Linkage
10 Actuation Handle
11 Electric Screw Actuator
12 Dryer Door
13 Fixed Base Portion of Baffle Member
14 Biased Insert Portion of Baffle Member
15 Biasing Spring Member
16 Follower Wheel Member
17 Drum Rotating Motor
18 Drum Rotating Drive Belt
19 Drum Rotating Bearings
20 Heating Unit
21 Exhaust
22 Telescoping or Flexible Duct
23 Seal Member
24 Sidewall of Drum Member
25 Front Panel of Drum Member
26 Access Opening of Drum Member
27 Air Inlet of Rear Panel
28 Air Outlet of Rear Panel
29 Baffle Member
30 Internal Surface of Drum Sidewall Construction Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

The invention is a clothes dryer featuring a movable rear panel which varies the internal working volume of the drying drum within the clothes drying machine. The invention includes a container for tumbling clothes in the clothes dryer appliance. The container comprises a drum member 2 rotatable on a horizontal, cylindrical axis. The drum member 2 includes a sidewall 24, a front panel 25 with an access opening 26 therein adapted for inserting and removing material to be tumbled, and a rear panel 3 moveably joined to the drum member's sidewall 24 by a peripheral seal 23 to form a contained volume in the drum member 2. The rear panel 3 includes an inlet 27 and an outlet 28 for circulating temperature conditioned air through the drum member's contained volume. A mounting and translational assembly is secured to the rear panel 3 for axial movement of the rear panel 3 within the drum member 2 to adjustably vary the drum member's contained volume, with the rear panel 3 held non-rotating during rotation of the drum member 2.

The invention also includes a clothes dryer appliance comprising a dryer chassis 1 with a drum member 2 rotatably mounted within the dryer chassis 1 on a horizontal, cylindrical axis. The drum member 2 includes a sidewall 24, a front panel 25 with an access opening 26 therein adapted for inserting and removing material to be tumbled, and a rear panel 3 moveably joined to the drum member's sidewall 24 by a peripheral seal 23 to form a contained volume in the drum member 2. The rear panel 3 includes an inlet 27 and an outlet 28 for circulating temperature conditioned air through the drum member's contained volume. One or more baffle members 29 are secured axially to an internal surface 30 of the sidewall 24 to promote tumbling of material within the drum member 2. A mounting and translational assembly is secured to the rear panel 3 for axial movement of the rear panel 3 within the drum member 2 to adjustably vary the drum member's contained volume, with the rear panel 3 held non-rotating during rotation of the drum member 2. A door 12 in the dryer chassis 1 provides access to the drum member's access opening. A drum rotating motor 17 and drive belt 18 assembly is positioned within the dryer chassis 1 and drivably coupled to the drum member 2 for rotation thereof. A heating unit 20 is present for providing temperature conditioned air to the drum member's rear panel inlet 27.

In a first embodiment of the invention, shown in FIG. 1, the movable rear panel 3 is positioned and moved by means of a motorized scissor mechanism 7, 8. The motorized scissor mechanism 7, 8 is controlled per selection by the operator of the machine. The scissor mechanism 7 is attached to the dryer chassis 1 by a rear panel mounting structure 4 incorporated into the dryer chassis 1. Rotation of a threaded rod by the drive motor 8 causes movement of the arms of the scissor mechanism 7 to either expand or contract the mechanism 7, depending upon the direction of rotation of the threaded rod. The expansion or contraction of the scissor mechanism 7 functions to position the movable rear panel 3 axially, but not rotatably, within the revolving drying drum 2. Telescoping or flexible ducts 22 connect the heating unit 20 and exhaust 21 to the movable rear panel 3. The heating unit 20 mounts to the dryer chassis 1. In operation, as the movable rear panel 3 advances forward within the revolving dryer drum 2, the rear panel's movement decreases the internal working volume of the dryer drum member 2.

Figure 2:
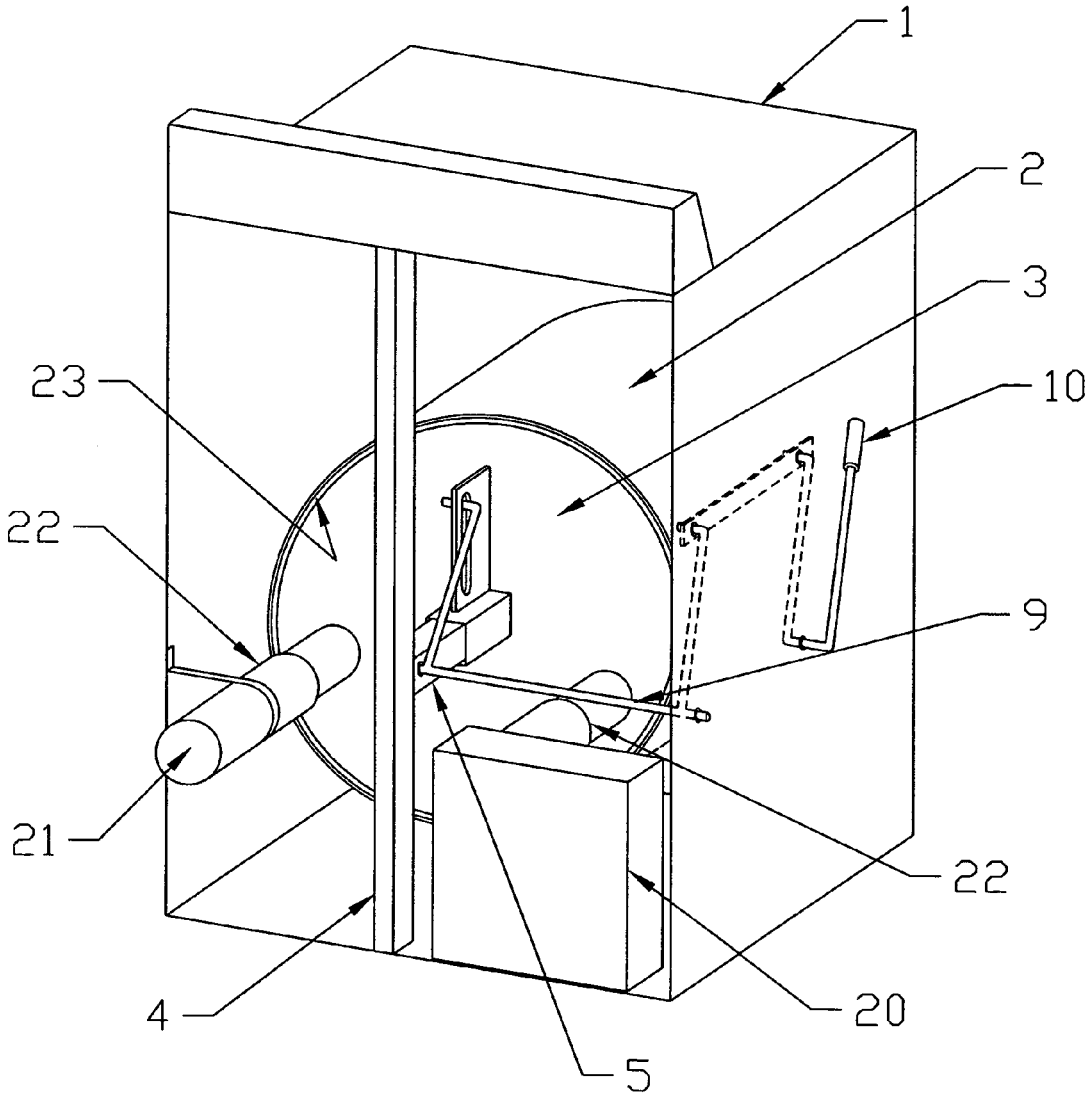
FIG. 2 is a rear perspective view of a clothes dryer with the invention incorporated. This figure shows an embodiment with a manually operated linkage actuator.

In a second embodiment of the invention, shown in FIG. 2, the movable rear panel 3 is located by a telescoping translational mechanism 5, such as a square tube or other such structure(s), which allow sliding, translational movement, but not rotating movement, of the rear panel 3. The telescoping translational mechanism 5 is attached to the dryer chassis 1 by a rear panel mounting structure 4. In this embodiment, the movable rear panel 3 is positioned axially within the revolving drum member 2 by means of an actuation linkage 9. The actuation linkage 9 is manually operated by an actuation handle 10. The actuation linkage 9 transfers movement of the actuation handle 10 to either extend or contract the telescoping translational mechanism 5, depending upon the direction of movement of the actuation handle 10. As in the first embodiment, telescoping or flexible ducts 22 connect the heating unit 20 and exhaust 21 to the movable rear panel 3. The heating unit 20 mounts to the dryer chassis 1.

Figure 3:
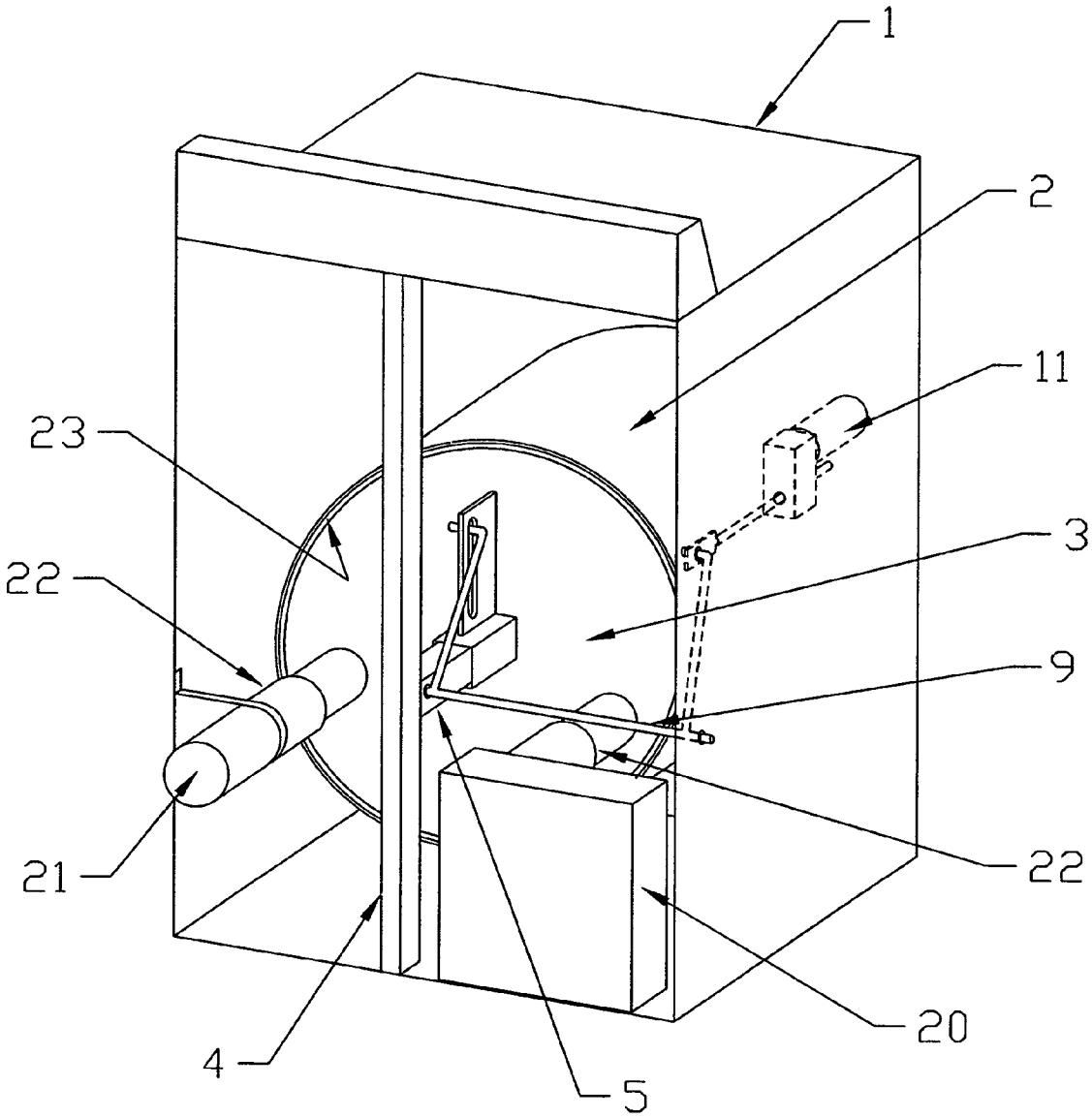
FIG. 3 is a rear perspective view of a clothes dryer with the invention incorporated. This figure show an embodiment with a motorized linkage actuator.

In a third embodiment of the invention, shown in FIG. 3, the movable rear panel 3 is positioned axially within the rotating drum by an actuation linkage 9 operated by an electric screw actuator 11 or other such device. The electric screw actuator 11, or other such device, is controlled per selection by the operator of the machine. Again, the actuation linkage 9 transfers movement of a threaded rod by the electric screw actuator 11 to either extend or contract the telescoping translational mechanism 5, depending upon the direction of rotation of the threaded rod.

Figure 4:
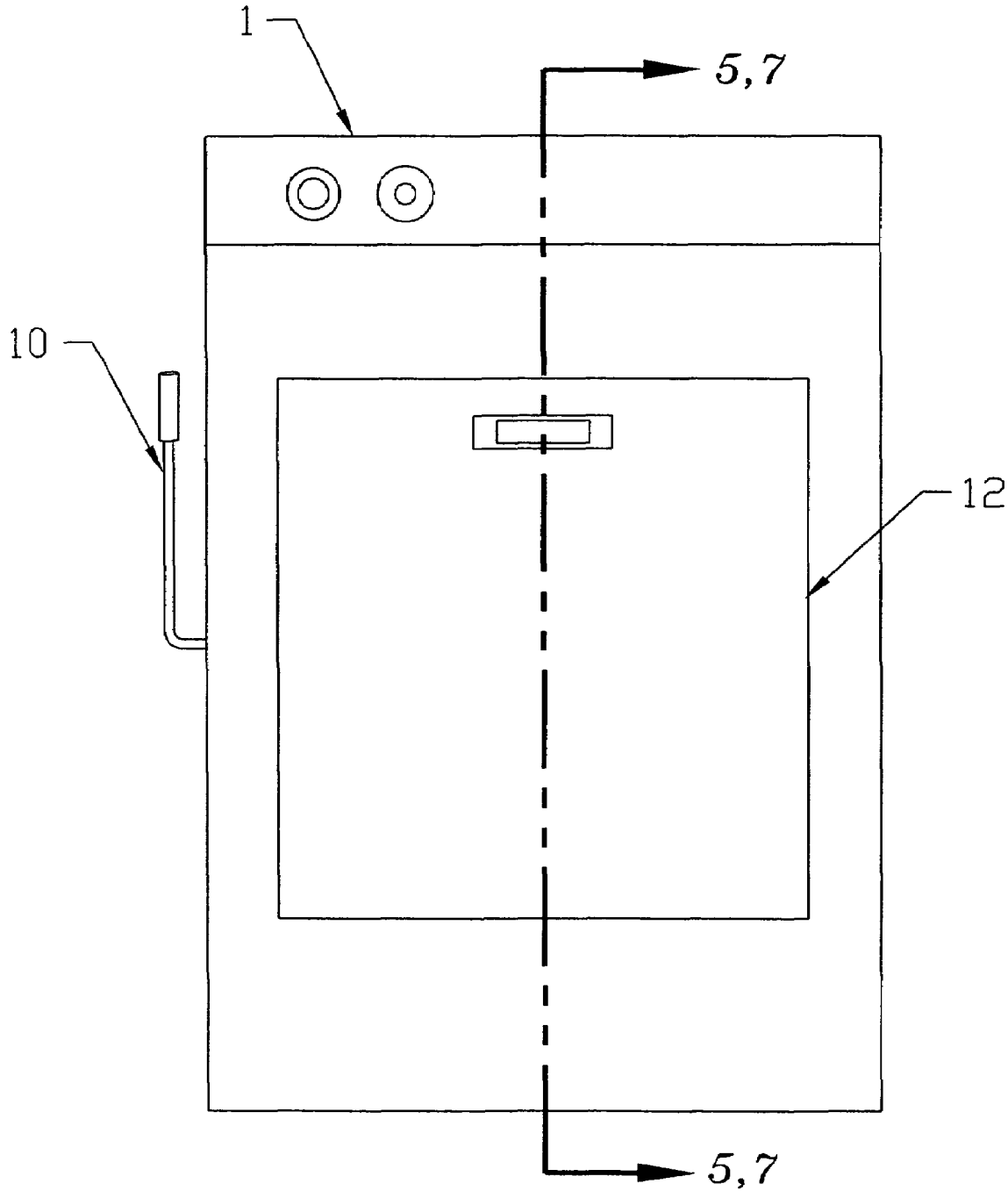
FIG. 4 is front view of a clothes dryer showing the section line that defines the section side views of FIGS. 5 and 7.
Figure 6:
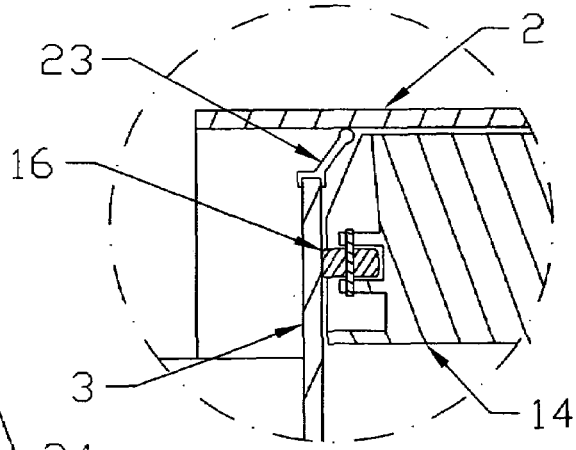
FIG. 6 is an enlarged detail view of the embodiment of the invention showing the movable rear wall of the dryer, the seal, and the telescoping, spring loaded baffle and its follower wheel.
Figure 5:
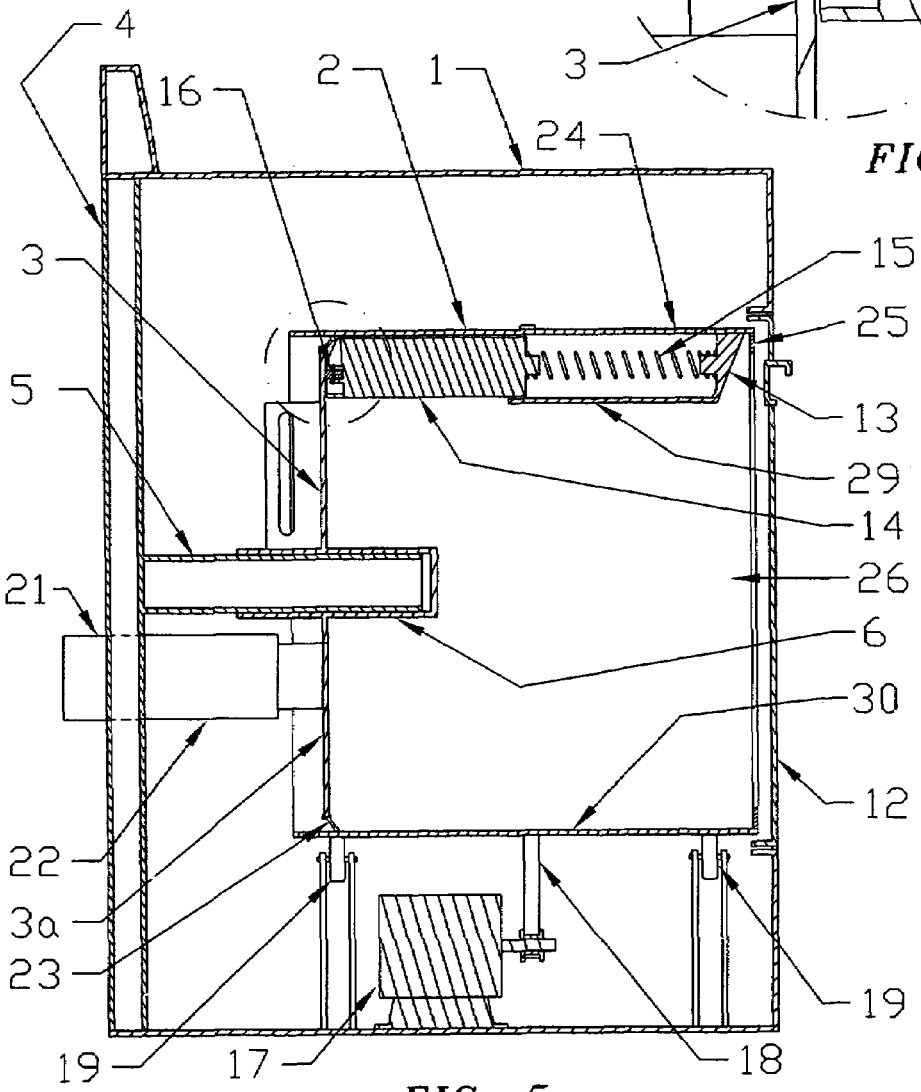
FIG. 5 is a side section view of the embodiment of the invention as shown in FIGS. 2 and 3. This figure shows the invention at near full internal working volume.
Figure 7:
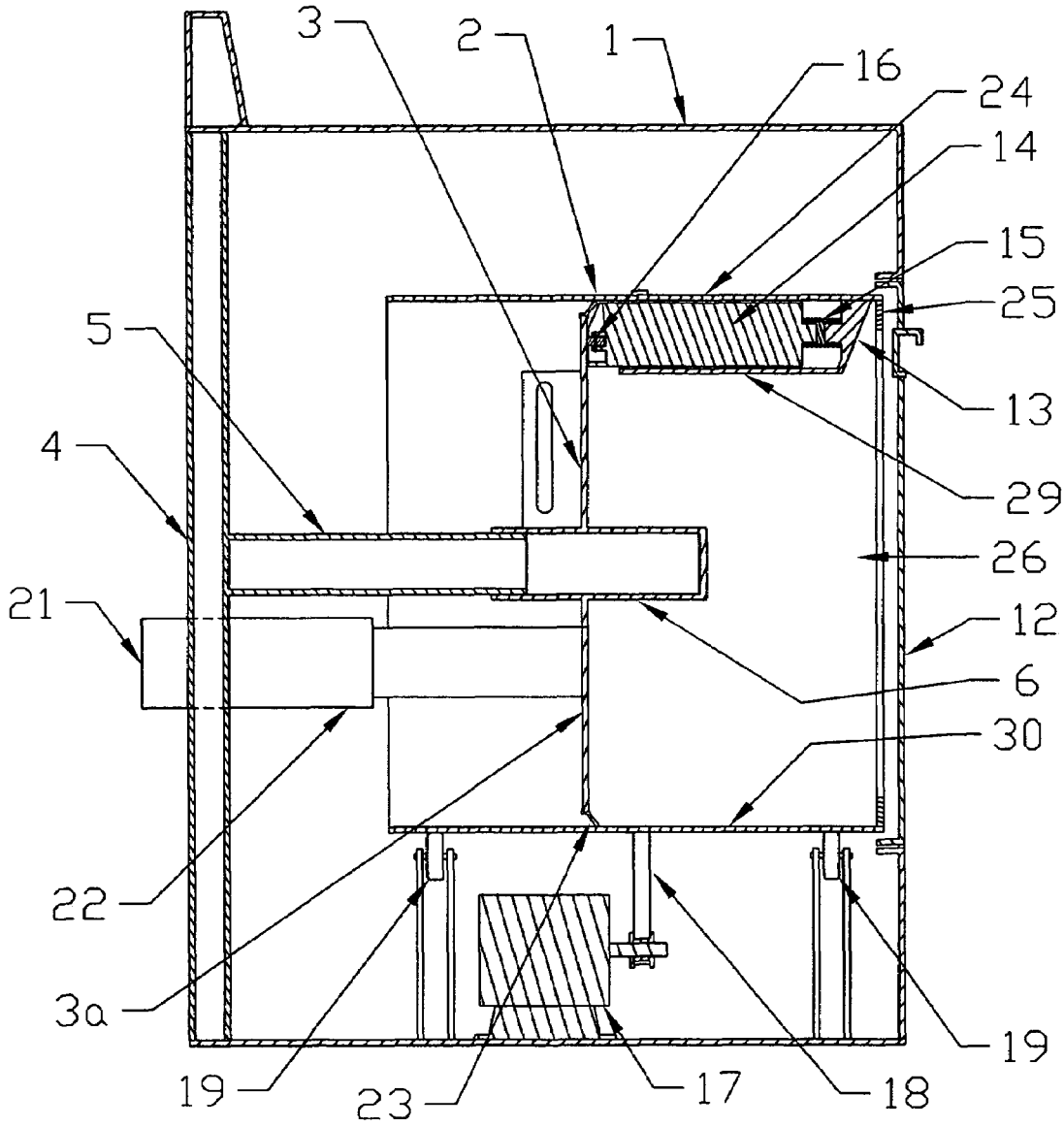
FIG. 7 is a side section view of the embodiment of the invention as shown in FIGS. 2 and 3. This figure shows the invention at a reduced internal working volume.
Figure 8:
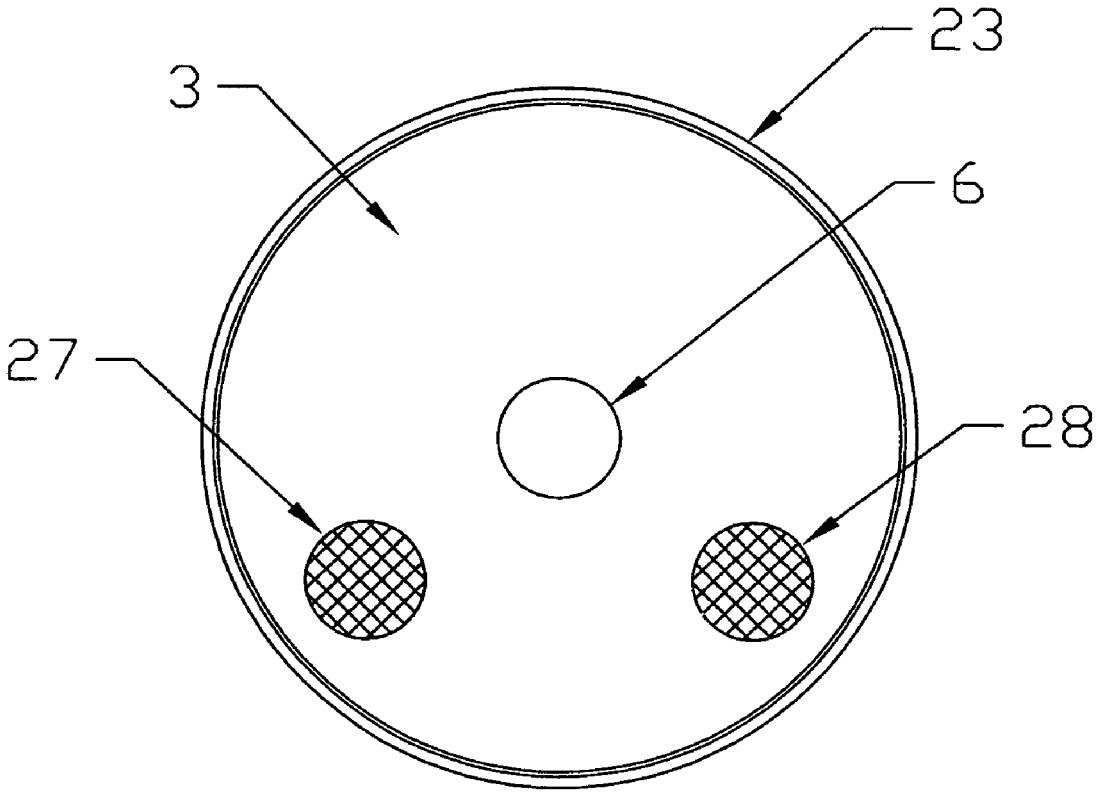
FIG. 8 is a front view of the rear panel incorporating the telescoping translational mechanism.

Additional internal features of the invention are shown in the section views of FIGS. 5, 6 and 7, where FIGS. 5 and 7 are section views of the dryer machine shown in FIG. 4. A seal 23 attached to the periphery of the movable rear panel 3 minimizes air leakage between the movable rear panel 3 and the revolving drying drum member 2. In the second and third embodiments described above, a protrusion 6 for additional engagement is incorporated into the movable rear panel 3 for increased stability of the movable rear panel 3 when the telescoping translational mechanism 5 is fully extended into the revolving drum 2. The protrusion 6 provides for additional engagement with the telescoping translational mechanism 5, without an increase in the depth of the dryer chassis 1. The telescoping translational mechanism 5 and associated protrusion 6 is shown in the retracted state in FIG. 5 and in an extended state in FIG. 7. FIG. 8 provides a front view of the rear panel 3 and seal member 23, from interior the drum member 2, including the protrusion 6 and the air inlet 27 and air outlet 28. The inlet 27 and outlet 28 optionally include a perforated or mesh covering to prevent entry of items into these openings. It is to be noted that the drum member 2 contains no perforations other than the access opening 26 and the air inlet 27 and air outlet 28, thereby retaining temperature conditioned air within the drum member 2 in intimate contact with items to be dried therein.

In a further embodiment of the invention, illustrated in FIGS. 5–7, the drum member 3 includes one or more baffle members 20 secured axially on an internal surface 30 of the sidewall 24. The clothes tumbling baffle member 20 includes a fixed base portion 13 incorporated into the revolving drum 2. The fixed base portion 13 accepts a telescoping baffle insert 14 biased by a spring 15. The telescoping baffle insert 14 moves slidably within the fixed baffle base 13. As the rear panel 3 moves axially within the revolving drum 2, a follower wheel 16, incorporated into the telescoping baffle insert 14, controls the degree of extension of the baffle insert 14. The follower wheel 16 rides against the movable rear panel 3. Other components and features of the clothes dryer, such as a drum rotation motor 17, drive belt 18, drum rotation bearings 19, and others are unchanged from conventional designs.

While the invention has been particularly shown and described with reference to preferred embodiments thereof, it will be understood by those skilled in the art that various changes in form and details may be made therein without departing from the spirit and scope of the invention.

I claim:

1. A container for tumbling clothes in a clothes dryer appliance, the container comprising;

(a) a drum member rotatable on a horizontal, cylindrical axis, the drum member including a sidewall, a front panel with an access opening therein adapted for inserting and removing material to be tumbled, a rear panel moveably joined to the drum member's sidewall by a peripheral seal to form a contained volume in the drum member;

the rear panel including an inlet and an outlet for circulating temperature conditioned air through the drum member's contained volume; and a mounting and translational assembly secured to the rear panel for axial movement of the rear panel within the drum member to adjustably vary the drum member's contained volume, the rear panel held non-rotating during rotation of the drum member.

2. The container for tumbling clothes in a clothes dryer appliance of claim 1, wherein the mounting and translational assembly includes a scissor mechanism with a drive motor, the scissor mechanism rigidly secured at one end to an exterior surface of the rear panel and supported at an opposite end by a stationary mounting structure.

3. The container for tumbling clothes in a clothes dryer appliance of claim 1, wherein the mounting and translational assembly includes a telescoping mechanism with an actuation linkage, the telescoping mechanism rigidly secured at one end to the rear panel, the telescoping mechanism supported at an opposite end by a stationary mounting structure.

4. The container for tumbling clothes in a clothes dryer appliance of claim 3, wherein the telescoping mechanism secured to the rear panel extends through the rear panel and into the drum member's contained volume.

5. The container for tumbling clothes in a clothes dryer appliance of claim 3, wherein the actuation linkage is motor operated.

6. The container for tumbling clothes in a clothes dryer appliance of claim 3, wherein the actuation linkage is manually operated.

7. The container for tumbling clothes in a clothes dryer appliance of claim 1, further including a baffle member secured axially to an internal surface of the sidewall to promote tumbling of material within the drum member.

8. The container for tumbling clothes in a clothes dryer appliance of claim 7, wherein the baffle member includes a fixed base portion with a biased insert portion contacting the axially adjustable rear panel of the drum member.

9. The container for tumbling clothes in a clothes dryer appliance of claim 8, wherein the baffle member's insert portion includes a biasing spring member and a follower wheel member contacting the axially moveable rear panel.

10. A clothes dryer appliance comprising:

a dryer chassis;

a drum member rotatably mounted within the dryer chassis on a horizontal, cylindrical axis, the drum member including a sidewall, a front panel with an access opening therein adapted for inserting and removing material to be tumbled, a rear panel moveably joined to the drum member's sidewall by a peripheral seal to form a contained volume in the drum member;

the rear panel including an inlet and an outlet for circulating temperature conditioned air through the drum member's contained volume;

a mounting and translational assembly secured to the rear panel for axial movement of the rear panel within the drum member to adjustably vary the drum member's contained volume, the rear panel held non-rotating during rotation of the drum member;

a door in the dryer chassis providing access to the drum member's access opening;

a drum rotating motor and drive belt assembly positioned within the dryer chassis and drivably coupled to the drum member for rotation thereof; and a heating unit for providing temperature conditioned air to the drum member's rear panel inlet.

11. The container for tumbling clothes in a clothes dryer appliance of claim 10, wherein the mounting and translational assembly includes a scissor mechanism with a drive motor, the scissor mechanism rigidly secured at one end to an exterior surface of the rear panel and supported at an opposite end by a stationary mounting structure secured to the dryer chassis.

12. The container for tumbling clothes in a clothes dryer appliance of claim 10, wherein the mounting and translational assembly includes a telescoping mechanism with an actuation linkage, the telescoping mechanism rigidly secured at one end to the rear panel, the telescoping mechanism supported at an opposite end by a stationary mounting structure secured to the dryer chassis.

13. The container for tumbling clothes in a clothes dryer appliance of claim 12, wherein the telescoping mechanism secured to the rear panel extends through the rear panel and into the drum member's contained volume.

14. The container for tumbling clothes in a clothes dryer appliance of claim 12, wherein the actuation linkage is motor operated.

15. The container for tumbling clothes in a clothes dryer appliance of claim 12, wherein the actuation linkage is manually operated.

16. The container for tumbling clothes in a clothes dryer appliance of claim 10, further including a baffle member secured axially to an internal surface of the sidewall to promote tumbling of material within the drum member.

17. The container for tumbling clothes in a clothes dryer appliance of claim 16, wherein the baffle member includes a fixed base portion with a biased insert portion contacting the axially adjustable rear panel of the drum member.

18. The container for tumbling clothes in a clothes dryer appliance of claim 17, wherein the baffle member's insert portion includes a biasing spring member and a follower wheel member contacting the axially moveable rear panel.

19. A clothes dryer appliance comprising:

a dryer chassis;

a drum member rotatably mounted within the dryer chassis on a horizontal, cylindrical axis, the drum member including a sidewall, a front panel with an access opening therein adapted for inserting and removing material to be tumbled, a rear panel moveably joined to the drum member's sidewall by a peripheral seal to form a contained volume in the drum member;

the rear panel including an inlet and an outlet for circulating temperature conditioned air through the drum member's contained volume;

a baffle member secured axially to an internal surface of the sidewall to promote tumbling of material within the drum member;

a mounting and translational assembly secured to the rear panel for axial movement of the rear panel within the drum member to adjustably vary the drum member's contained volume, the rear panel held non-rotating during rotation of the drum member;

a door in the dryer chassis providing access to the drum member's access opening;

a drum rotating motor and drive belt assembly positioned within the dryer chassis and drivably coupled to the drum member for rotation thereof; and a heating unit for providing temperature conditioned air to the drum member's rear panel inlet.

20. The container for tumbling clothes in a clothes dryer appliance of claim 19, wherein the baffle member includes a fixed base portion with a biased insert portion contacting the axially adjustable rear panel of the drum member.

21. The container for tumbling clothes in a clothes dryer appliance of claim 20, wherein the baffle member's insert portion includes a biasing spring member and a follower wheel member contacting the axially moveable rear panel.

* * * * *